US005597080A

United States Patent [19]

Culwell

[11] Patent Number: 5,597,080

[45] Date of Patent: Jan. 28, 1997

[54] SNAG LOAD PROTECTION SYSTEM FOR A CRANE

[75] Inventor: Jeff C. Culwell, Savannah, Ga.

[73] Assignee: Kranco Crane Services, Inc., Houston, Tex.

[21] Appl. No.: 284,056

[22] Filed: Aug. 2, 1994

[51] Int. Cl.[6] ..... B66C 13/10

[52] U.S. Cl. ..... 212/278; 212/250; 212/274; 212/308

[58] Field of Search ..... 212/274, 278, 212/281, 308, 250, 350

[56] References Cited

U.S. PATENT DOCUMENTS

| | | | |
|---|---|---|---|
| 3,129,821 | 4/1964 | Graham et al. | 212/250 |
| 3,653,518 | 4/1972 | Polen | 212/274 |
| 3,837,503 | 9/1974 | Komatsu | 212/274 |
| 3,854,593 | 12/1974 | Gross | 212/278 |
| 3,912,093 | 10/1975 | Kruschke | 212/278 |
| 4,025,055 | 5/1977 | Strolenberg | 212/308 |
| 4,157,736 | 6/1979 | Carhert | 173/11 |
| 4,222,491 | 9/1980 | Geppert | 212/278 |
| 4,236,864 | 12/1980 | Couture et al. | 414/699 |
| 4,252,243 | 2/1981 | Robinson | 212/149 |
| 4,411,368 | 10/1983 | Manjot | 212/278 |
| 4,433,612 | 2/1984 | Spielvogel | 91/514 |
| 4,442,922 | 4/1984 | Johannson | 212/350 |
| 4,598,829 | 7/1986 | Young et al. | 212/149 |
| 4,787,524 | 11/1988 | Cobb et al. | 212/278 |
| 5,018,631 | 5/1991 | Reimer | 212/250 |
| 5,163,570 | 11/1992 | Mundis et al. | 212/155 |
| 5,421,468 | 6/1995 | Wright | 212/250 |

FOREIGN PATENT DOCUMENTS

| | | | |
|---|---|---|---|
| 224446 | 11/1985 | European Pat. Off. | B66C 23/90 |
| 11591 | 1/1977 | Japan | 212/308 |
| 2078197 | 1/1982 | United Kingdom | B66C 23/90 |
| 2142313 | 1/1985 | United Kingdom | B66C 13/20 |

*Primary Examiner*—Thomas J. Brahan
*Attorney, Agent, or Firm*—Harrison & Egbert

[57] ABSTRACT

A snag load protection system for a train including a guide frame, a sheave housing slidably received within the guide frame, and a hydraulic cylinder connected to the guide frame and to the sheave housing. The hydraulic cylinder serves to exert a compressive force against the sheave housing so as to resist relative movement between the guide frame and the sheave housing when forces exerted by the sheave housing are within a predetermined value. A relief valve is connected to the hydraulic cylinder for releasing hydraulic fluid from the hydraulic cylinder when the force is greater than the predetermined value. Pressure and position limit switches are connected to a motor so as to stop the movement of a hoist rope when forces exceed the predetermined value.

5 Claims, 7 Drawing Sheets

SNAG LOAD PROTECTION SYSTEM FOR A CRANE

TECHNICAL FIELD

The present invention relates to safety systems for cranes. More particularly, the present invention relates to hydraulic systems for crane operation. Furthermore, the present invention relates to systems for the protection of a crane against overloads and snags.

BACKGROUND ART

Cranes are commonly employed for the lifting and transport of objects. In many circumstances, very large cranes are operated so as to hoist large loads. Such large cranes are often used at port facilities for the transport of containers to and from cargo ships. Normally, the loading and unloading of ships at port facilities must be carried with a large amount of concern for safety. The handling of containers at port facilities must be carried out efficiently and effectively so as to prevent damage to cargo and to minimize the costs associated for the unloading and/or loading activities.

One of the common problems encountered by such cranes as such facilities is the occurrence of a "snag load". These snag loads occur whenever the crane is employed to lift weight beyond the capacity of the crane. Typically, such snag loads occur when the container is caught or attached to another object. Whenever a snag load occurs, it is important to be able to shut down the operation of the crane before the hoist ropes break or the structure of the crane becomes damaged. Under such circumstances, if the hoist motor of the crane is not stopped, then the motor and hoist system can become permanently damaged and require replacement.

Conventionally, snag load systems are in place which stop the motor upon the occurrence of a "snag load". Conventional snag load protection systems employ pressure sensors and/or transducers along the hoist rope. When pressures are encountered above a predetermined level, then the transducer will send a signal to stop the motor. Unfortunately, because of the size of the motors employed in such crane systems, the motor will not immediately stop upon receiving the signal. The continued momentum of the crane motor will still cause excessive stresses to be placed upon the hoist rope, upon the crane structure, hoist system, and upon the motor, even when the motor is turned off. As such, a need has developed so as to prevent these adverse effects from affecting the crane system adversely.

In the past, various patents have issued relating to crane protection systems. U.S. Pat. No. 4,157,736, issued on Jun. 12, 1979, to R. E. Carbert teaches an overload protection apparatus for hydraulic equipment. This system includes an overload or relief valve having a manifold to which the power lines of all of the actuators are connected. These connections are directed through check valves so that fluid within the lines will be directed only to the relief valve. Any overpressure condition operates the pilot valve so as to unload the pressure lines of the actuators and to prevent their continued operation as long as they are in the overstressed condition.

U.S. Pat. No. 4,236,864, issued on Dec. 2, 1980, to Couture et al. describes a safety control system for a boom of a crane. This system is employed so as to prevent the exceeding of the uppermost sink elevation of each articulated section of a boom and the safe swinging limits right and left of the boom.

U.S. Pat. No. 4,252,243, issued on Feb. 24, 1981, to Robinson et al. describes a crane safety device which serves to relieve hydraulic pressure from the crane motor in response to the horizontal radius of the free end of the rope so that at a given radius the motor can lift only a given maximum load. A means is provided for releasing the brake when the free end of the rope is a given distance below the crane.

U.S. Pat. No. 4,433,612, issued on Feb. 28, 1984, to Spielvogel et al. describes a safety control device for protecting hydraulically held loads against uncontrolled pressure overloading. This system employs pressure relief valves so as to prevent overload conditions from affecting the lowering and lifting cylinders of a hydraulic press.

U.S. Pat. No. 4,598,829, issued on Jul. 8, 1986, to Young et al. shows a hydraulic circuit for a crane. An unloading valve is interposed in the boom hoist circuit so as to dump the boom hoist pump directly to the reservoir when pressure in the pump circuit becomes excessive. A boom limit valve, actuated as the boom reaches both upper and lower limits, also causes the unloading valve to dump the boom hoist pump to the reservoir.

U.S. Pat. No. 5,018,631, issued on May 21, 1991, to H. J. Reimer shows a hoist device for a container crane. This system employs four hoist ropes. One end of each rope is wound on a drum to be driven in either direction to hoist or lower the container. The second end of each rope is connected to a double-acting hydraulic cylinder. The cylinders are controlled by a valve system to dampen the swaying of the load, to reset the ropes, and for skewing, trimming and lifting the load. Various valves are employed so as to prevent overload conditions.

U.S. Pat. No. 5,163,570, issued on Nov. 17, 1992, to Mundis et al. describes a load sensing device for a boom mounted on a vehicle. A worm gear arrangement is provided for articulating the boom. A hydraulic chamber on each side of the worm gear controls the operation of the boom. A thrust of the worm gear in the direction of the hydraulic chamber increases the fluid pressure in the chamber so as to cause the fluid pressure in the closed hydraulic circuit to increase. The pressure increase is sensed by a fluid pressure gage which sends a signal so as to terminate input power to the worm gear if the increase in fluid pressure is above a predetermined pressure.

British Patent No. 2,142,313, published on Jan. 16, 1985, teaches a hydraulic circuit for a crane having a plurality of pumps. If the hydraulic load on the pumps reaches a point where the motor for the pumps is near a stalling condition, pressure in a pilot passage increases to a point where an internal relief valve will shift. This connects the pilot passage to the reservoir side of the pumps so as to cause the unloading valve to shift.

British Patent No. 2,078,197, published on Jan. 6, 1982, describes a load limiting device for hydraulically operated cranes. A pressure switch senses the pressure in the hydraulic cylinder of the of the lifting arm. The switch is disconnected when the pressure reaches a predetermined maximum value.

European Patent No. 224,446, published on Jun. 3, 1987, describes a load limiting device for a hydraulic crane which includes a load sensing means incorporating two-way, two-position response valves which pick up pressure signals from the end of the hydraulic cylinder. The response valve connects with a pump and a send line through which the signal is transmitted. When the signal from the cylinder exceeds the maximum rated capacity of the crane, the valve opens and stops fluid flow to the lift cylinders.

It is an object of the present invention to provide a snag load protection system which prevents damage to the crane.

It is another object of the present invention to provide a snag load protection system that can be retrofitted to existing cranes.

It is another object of the present invention to provide a snag load protection system that maximizes the safety of the crane operation.

It is another object of the present invention to provide a snag load protection system that is easy to use, easy to install, and relatively inexpensive.

These and other objects and advantages of the present invention will become apparent from a reading of the attached specification and appended claims.

SUMMARY OF THE INVENTION

The present invention is a snag load protection system for a crane that comprises a guide frame, a sheave housing which slides within the guide frame and having means therein for receiving a rotatable sheave, and a hydraulic cylinder connected to the guide frame and to the sheave housing so as to exert a compressive force against the sheave housing for resisting relative movement between the guide frame and the sheave housing when forces exerted by the sheave housing are within a predetermined value. The hydraulic cylinder includes a piston rod having one end connected to the sheave housing, a cylinder receiving an opposite end of the piston rod, and a hydraulic supply connected to the cylinder so as to supply hydraulic fluid, at a desired pressure, to the cylinder. The hydraulic fluid supply includes a fluid reservoir, a fluid line extending from the fluid reservoir to the cylinder, and a pump connected to the fluid line so as to pressurize the fluid in the cylinder to a minimum desired level. A pressure switch is connected to the fluid line and to the pump so as to actuate the pump when the pressure of the fluid in the line falls below a minimum desired value.

The hydraulic cylinder of the present invention includes a relief valve connected to the hydraulic fluid supply. This relief valve serves to release the fluid from the cylinder when the forces exceed the predetermined value. A pressure sensor is connected to the hydraulic cylinder so as to transmit a signal to the hoist motor when the forces exceed a predetermined value. A position limit switch is also connected to the guide frame for transmitting a signal to the hoist motor when the relative movement between the guide frame and the sheave housing exceeds a predetermined distance. The signal transmitted by the pressure sensor or by the position limit switch serves to stop the hoist motor and the hoisting activity.

The guide frame includes a plurality of horizontal rails extending parallel to each other. The sheave housing has a plurality of slide members formed on an exterior surface. The slide members are in slidable relationship with the rails. The rails are of a generally square tubular configuration. Each of the slide members has an L-shaped configuration. Each of the slide members is made of an ultra-high molecular weight polyethylene material.

DETAILED DESCRIPTION OF THE INVENTION

Figure 1:
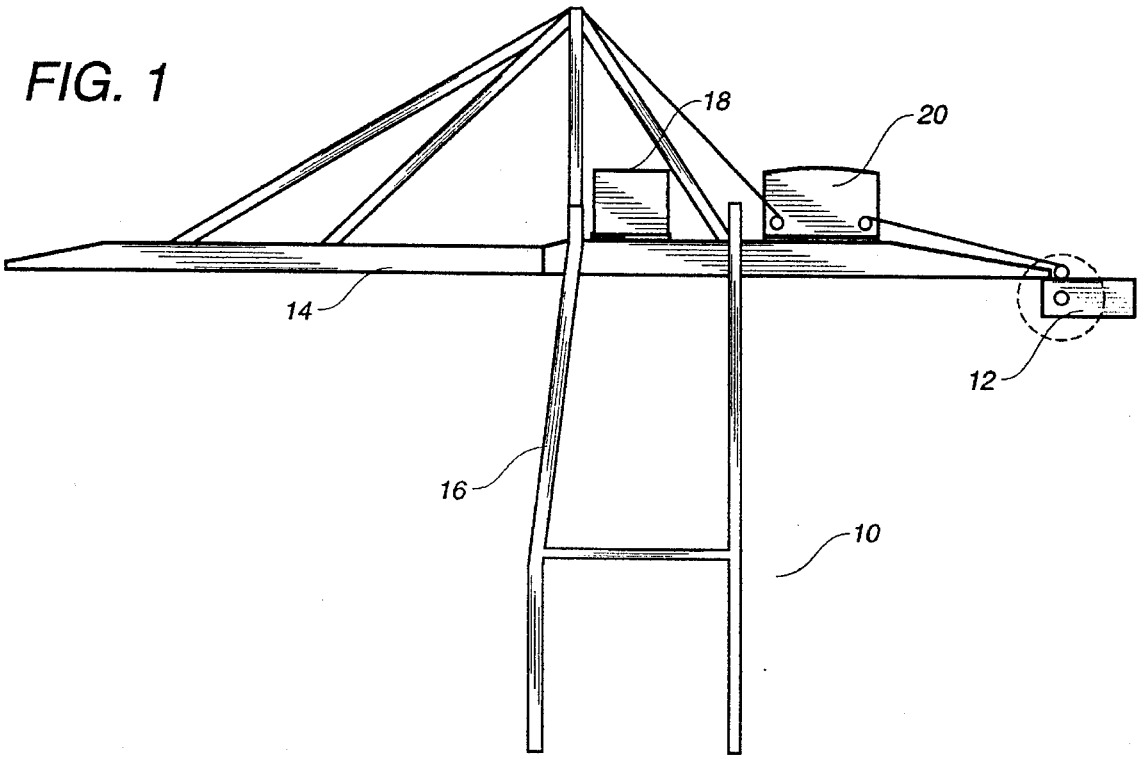
FIG. 1 is a side elevational view of a crane system employing the present invention.

Referring to FIG. 1, there is shown at 10 a crane system employing the snag load protection 12 of the present invention. The crane 10 is of a conventional container-crane system. The container-crane system 10 is typically employed for the loading and unloading of ships. However, it is within the scope of the present invention that the snag load protection system 12 of the present invention can be employed on cranes other than container cranes. The container crane 10 has a boom 14 that extends in the waterside direction and is held stationary for cargo handling. The boom 14 is supported above the earth by frame 16. A movable operator compartment 18 is positioned on the boom 14. The motor 20 serves to control the lifting and/or lowering of the hoist rope. It can be seen that the snag load protection system 12 is mounted on the landside end of the boom 14. Within the scope of the present invention, the boom 14, and the crane system 10, can be retrofitted by adding the snag load protection system of the present invention to the existing structure of the crane system 10.

Figure 2:
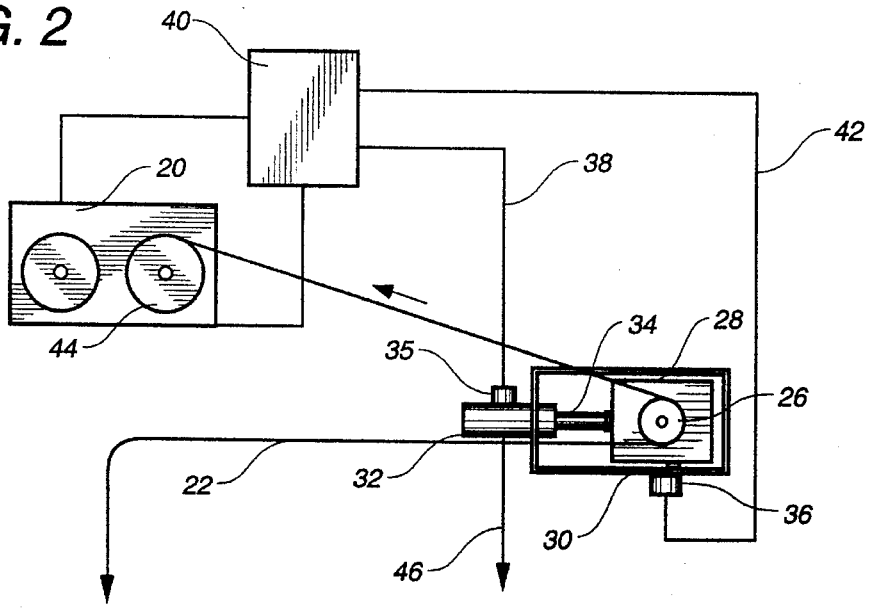
FIG. 2 is a simplified diagrammatic illustration of the operation of the present invention.

FIG. 2 is a diagrammatic illustration of the snag load protection system of the present invention. In this system, it can be seen that a hoist rope 22 extends from the motor 20 through the snag load protection system 12. Under the normal circumstances of usage, the hoist rope 22 will have a load attached to the end 24. The hoist rope 22 passes around a portion of a sheave 26 contained within a sheave housing 28. The sheave housing 28 is mounted within a guide frame 30. A hydraulic cylinder 32 is connected to the guide frame 30 and has a piston rod 33 that exerts a compressive force against the sheave housing 28 so as to resist relative movement between the guide frame 30 and the sheave housing 28 when the forces exerted by the hoist rope 22 on the sheave 26 are below a predetermined value. A pressure sensor 34 is connected to the hydraulic cylinder 32. A position limit switch 36 is affixed to the guide frame 30. The pressure sensor 34 is electrically, or otherwise, connected along line 38 to a control panel 40. Similarly, the position limit switch 36 is connected along line 42 to the control panel 40. The control panel 40 is connected to the motor 20 so as to allow the motor 20 to be turned on and off as desired. The pressure sensor 34 serves to transmit a signal along lines 38 when the hydraulic pressure within the hydraulic cylinder 32 exceeds a predetermined value. Similarly, the position limit switch 36 will transmit a signal along line 42 to the control panel 40 when the relative movement between the guide frame 30 and the sheave housing 28 exceeds a predetermined distance. The signals which are transmitted to the control panel 40 will signal the motor 20 to stop.

As was stated previously, whenever a "stop" signal is sent to the motor 20, there will continue to be rotation by the winch 44 of the motor. This continued rotation is caused by the momentum of the winch 44. Under normal circumstances, this continued rotation can cause damaging impact forces to be imparted to the hoist rope 22, to the structure of the crane, to the sheaves 26, and to the motor 20. Therefore, the snag load protection system 12 was developed so as to "soften" the impact of the snag load.

When an overload condition is encountered upon the hoist rope 22, the hoist rope 22 will impart forces to the sheave 26. As a result, there will be a tendency of the sheave housing 28 to act against the piston rod 33 of the hydraulic cylinder 32. The pressure of the fluid within the interior of the hydraulic cylinder 32 will continue to increase. When these pressures are greater than a predetermined value, a relief valve connected to the cylinder 32, will release hydraulic fluid outwardly through line 46. The piston rod 33 will move toward the hydraulic cylinder 32. At the same time, the pressure sensor 34 will detect this pressure buildup on the interior of the hydraulic cylinder 32. As such, a signal will be transmitted along line 38 so as to stop the motor 20. Additionally, since the sheave housing 28 is moving toward the hydraulic cylinder 32 within the guide frame 30, the position limit switch 36 will also send a signal to the control panel 40 so as to stop the motor. The release of the hydraulic fluid through line 46 will compensate for the continued rotation of the winch 44 of motor 20 following the transmission of the "stop" signal by allowing slack into the hoist ropes. As such, adverse effects caused by the overload condition are minimized. The continued upward travel of the load at the end 24 of the hoist rope 22 is effectively stopped. At this point in time, the conditions which cause the "snag" can be corrected and/or the load lowered. The system 12 cannot be restarted without correction of the condition causing the snag load. An operator with a key is necessary to restart the system 12 after the snag load problem is corrected.

Figure 3:
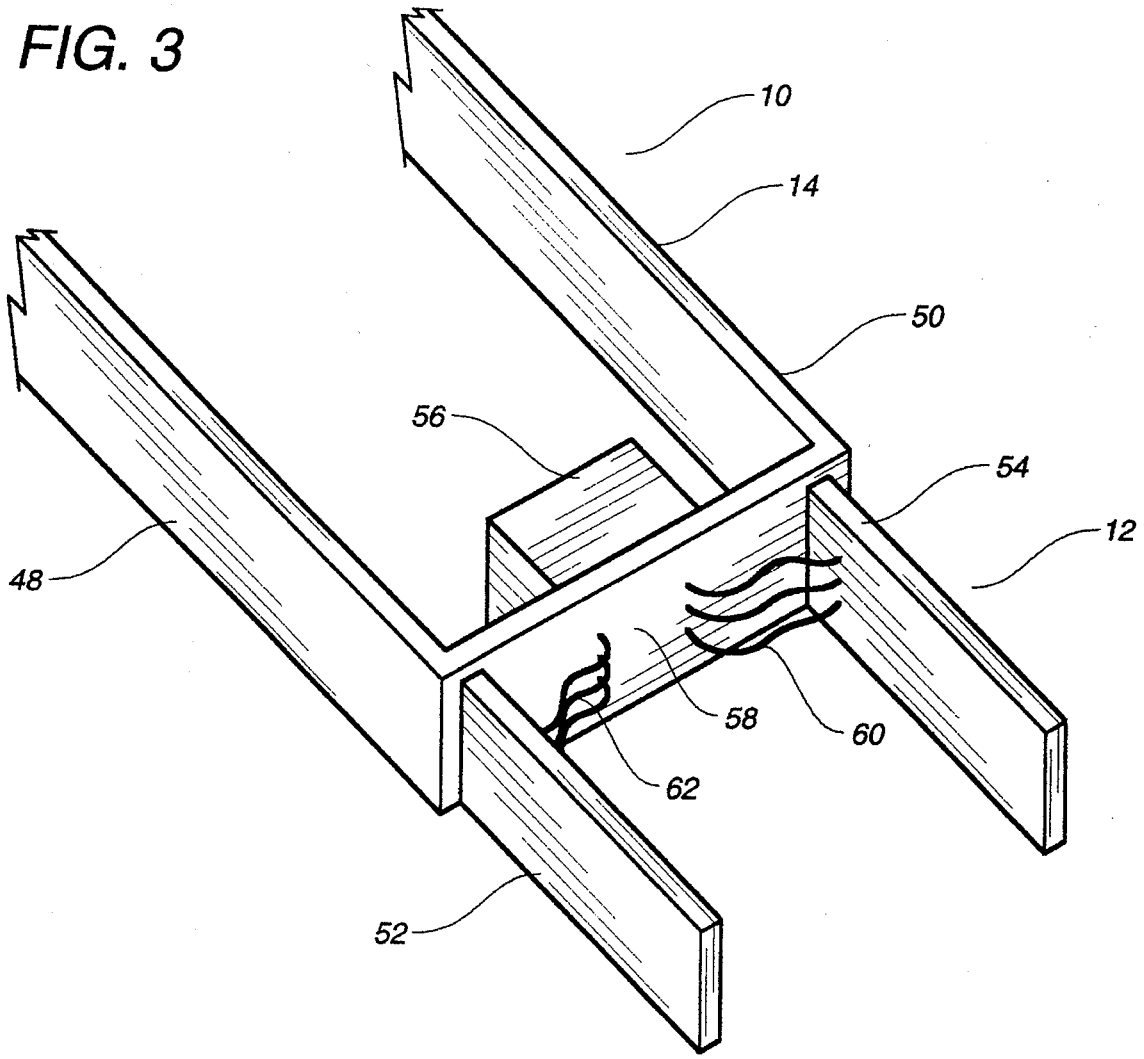
FIG. 3 is a perspective view of the arrangement of the system of the present invention as employed on the crane structure.

FIG. 3 shows the configuration of the snag load protection system 12 as positioned at the end of the boom 14 of the crane system 10. During the normal lifting of containers, a pair, or more, of hoist ropes are employed. This arrangement is designed so as to keep the load in a level condition. Typically, the load is connected to the hoist ropes through a spreader. It can be seen that the boom 14 has a port side boom 48 and a starboard side boom 50. Similarly, the snag load protection system 12 will have a port side unit 52 and a starboard side unit 54. The main hydraulic supply 56 is positioned at the cross member 58 of the boom 14. Hydraulic lines 60 extend from the hydraulic supply 56 to the starboard side unit 54. Hydraulic lines 62 extend from the fluid reservoir 56 to the port side unit 52. The actual configuration of the hydraulics of the present invention are described in greater detail in FIG. 10. The snag load protection system 12 can be conveniently retrofit to the crane.

Figure 4:
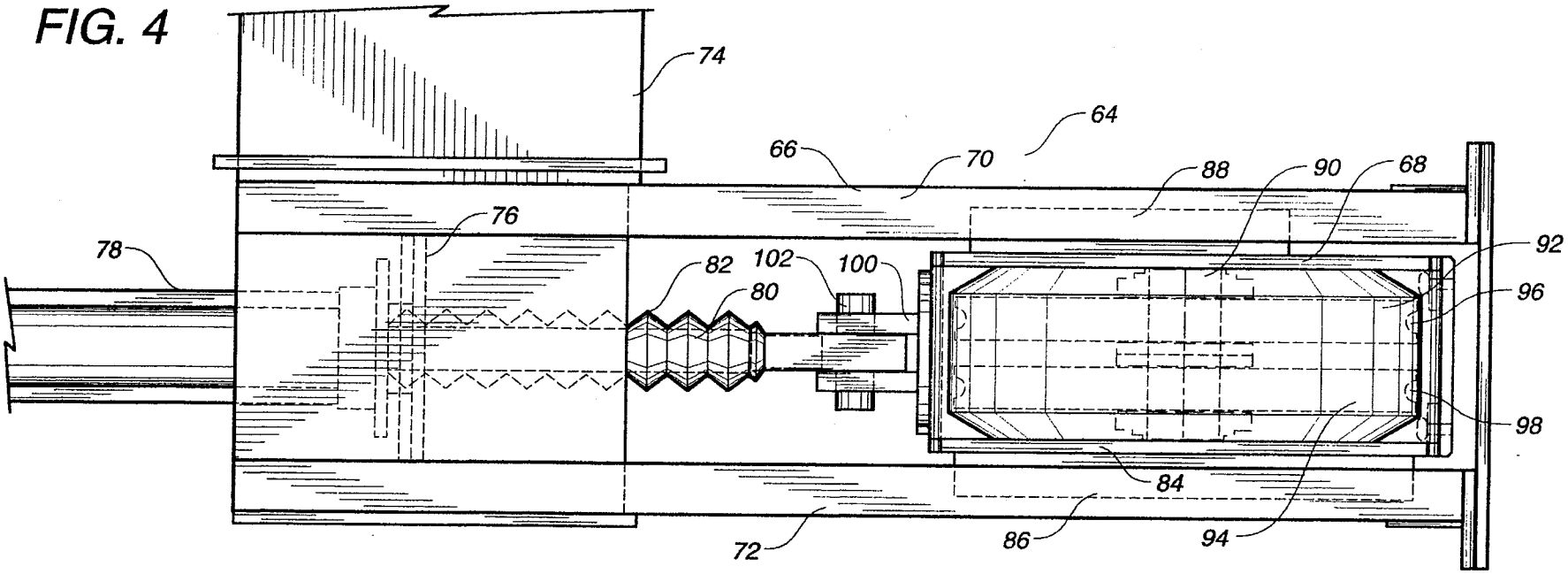
FIG. 4 is a plan view showing the assembly of the present invention in its extended normal position.

FIG. 4 shows the assembly 64 of the snag load protection system of the present invention. The assembly 64 includes a guide frame 66 and a sheave housing 68. The sheave housing 68 is positioned in slidable relationship with the guide frame 66. It can be seen that the guide frame 66 has a pair of rails 70 and 72. The sheave housing 68 is received between these rails 70 and 72. The pair of rails 70 and 72 comprise the frame 66. Frame 66 is mounted on a subplate which is mounted on an existing girder beam 74 of the crane.

The guide frame 66 has a plate 76 extending between the pair of rails 70 and 72. The hydraulic cylinder 78 is affixed to the plate 76. The hydraulic cylinder 78 has a piston rod 80 which extends outwardly so as to be connected to the sheave housing 68. A protective bellows 82 extends around the piston rod 80.

The sheave housing 68 includes a frame 84 that has slide members 86 and 88 formed so as to be in slidable relationship with the rails 72 and 70, respectively, of the guide frame 66. The frame 84 of the sheave housing 68 has an axle 90 extending therethrough. Sheaves 92 and 94 are rotatably mounted on the axle 90. In normal use, the hoist rope will extend through the grooves 96 and 98 of the sheaves 92 and 94, respectively.

The piston rod 80 is connected to the sheave housing 68 through the use of a clevis bracket 100. A clevis pin 102 connects the end of the piston rod 80 to the clevis bracket 100.

FIG. 4 shows the assembly 64 of the snag load protection system of the present invention in its extended normal position. When forces below a predetermined value are encountered by the sheave housing 68, the sheave housing 68 will reside in the position shown in FIG. 4. In other words, the piston rod 80 of the hydraulic cylinder 78 will be in its fully extended position. The piston rod 80 exerts a compressive force upon the sheave housing 68.

Figure 5:
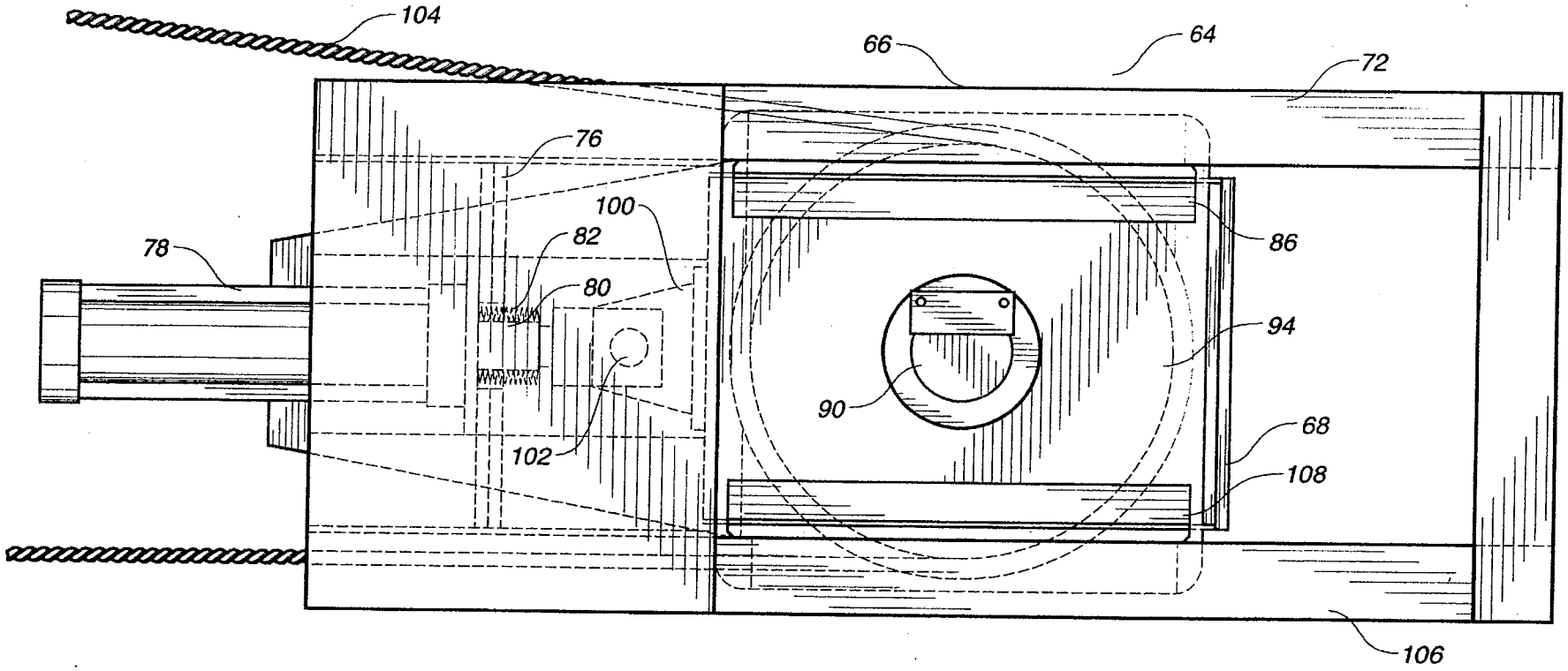
FIG. 5 is a side elevational view of the assembly of the present invention in its retracted (overload tripped) position.

FIG. 5 shows a side view of the assembly 64 in its proper configuration when an overload condition occurs that affects the hoist rope 104. It can be seen in FIG. 5 that the hoist rope 104 extends downwardly and around a portion of the sheave 94. The hoist rope 104 will have a load connected at its lower end.

In FIG. 5, it can be seen that the guide frame 66 has a top rail 72 and a bottom rail 106. The sheave housing 68 is positioned between the top rail 72 and the bottom rail 106. The sheave housing 68 includes a slide member 86 that engages the top rail 72 and a bottom slide member 108 that engages the bottom rail 106. In this manner, the sheave housing 68 is firmly secured within the rails of the guide frame 66.

FIG. 5 shows how an overload condition affects the snag load protection system of the present invention. In such a circumstance, the hoist rope 104 will become very taut. The forces imparted by the hoist rope 104 upon the sheave 94 will cause the sheave 94 to pass the forces to the sheave housing 68. The sheave housing 68 will then exert compressive forces against the end of the piston rod 80. When the forces imparted by the sheave housing 68 exceed the predetermined value of the hydraulic pressure within the cylinder 78, the piston rod 80 will move inwardly towards the cylinder 78. The sheave housing 68 will move horizontally along the horizontal rails 72 and 106 of the guide frame 66. The piston rod 80 will continue to move inwardly as the relief valve allows the hydraulic fluid to pass from the hydraulic cylinder.

Figure 6:
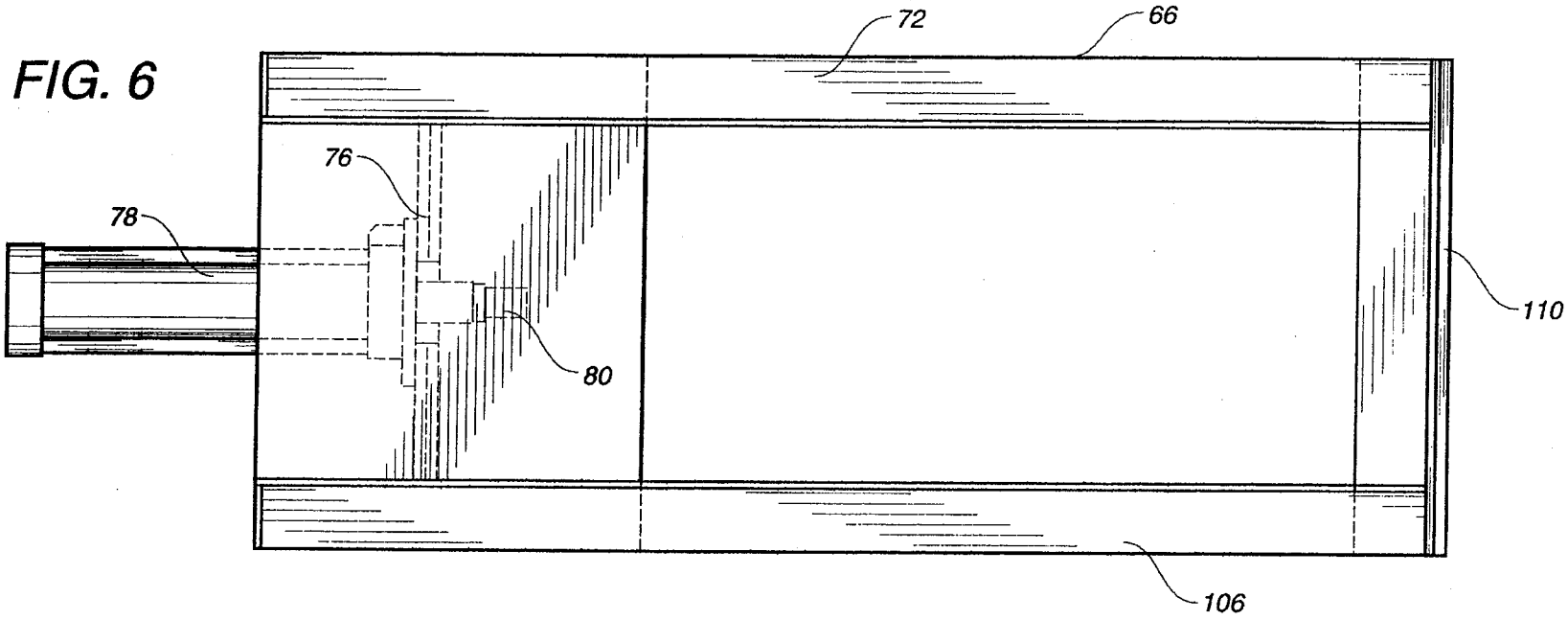
FIG. 6 is a side elevational view of the guide frame and hydraulic cylinder of the present invention.

FIG. 6 is an isolated side view of the frame 66 of the assembly 64 of the present invention. In particular, it can be seen that the frame 66 has a top rail 72 and a bottom rail 106. There are corresponding rails on the other side of the frame 66 so as to give the frame 66 a generally rectangular configuration. An end plate 110 is affixed to the frame 66 at the end of rails 72 and 106. Each of the rails 72 and 106 has a square tubular configuration. The rails 72 and 106 should have sufficient strength so as to withstand the forces imparted thereto. The opposite end of the rail 72 and 106 are supported in their proper position by the plate 76. Plate 76 is a strong structural plate that extends between the rails 72 and 106 and also supports the hydraulic cylinder 78.

Figure 7:
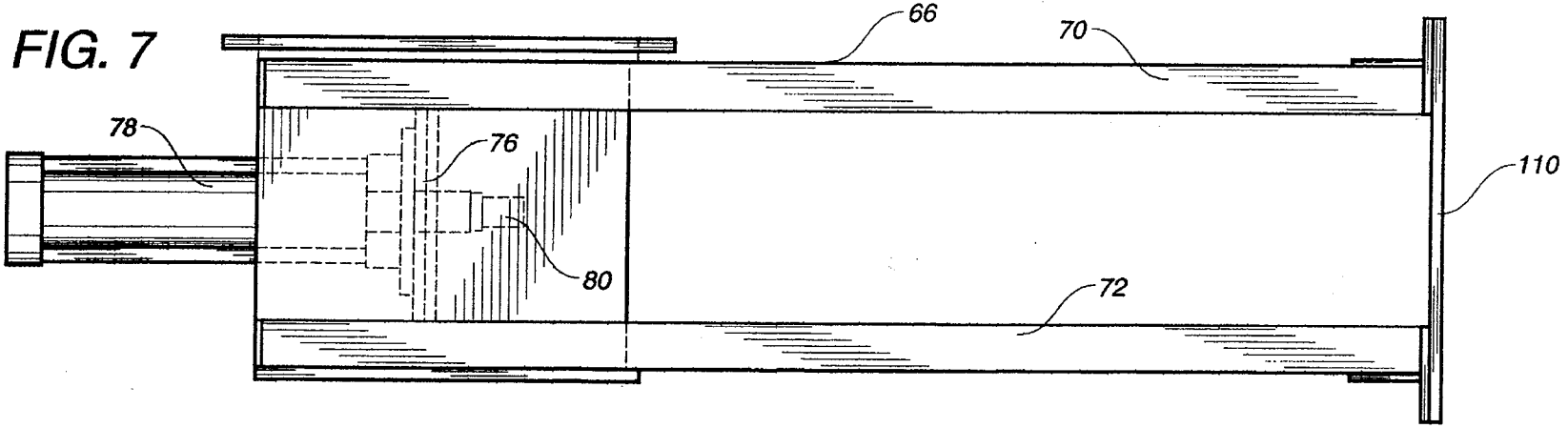
FIG. 7 is a plan view of the guide frame and hydraulic cylinder of the present invention.

FIG. 7 shows a top view of the frame 66. In particular, it can be seen that the rails 70 and 72 extend in parallel relationship to each other and also in parallel relationship to their corresponding bottom rails. The end plate 110 extends between the rails 70 and 72. The plate 76 also extends between these rails. The hydraulic cylinder 78 is positioned between rails 70 and 72 and is generally centralized between rails 72 and 106 (shown in FIG. 6).

Figure 8:
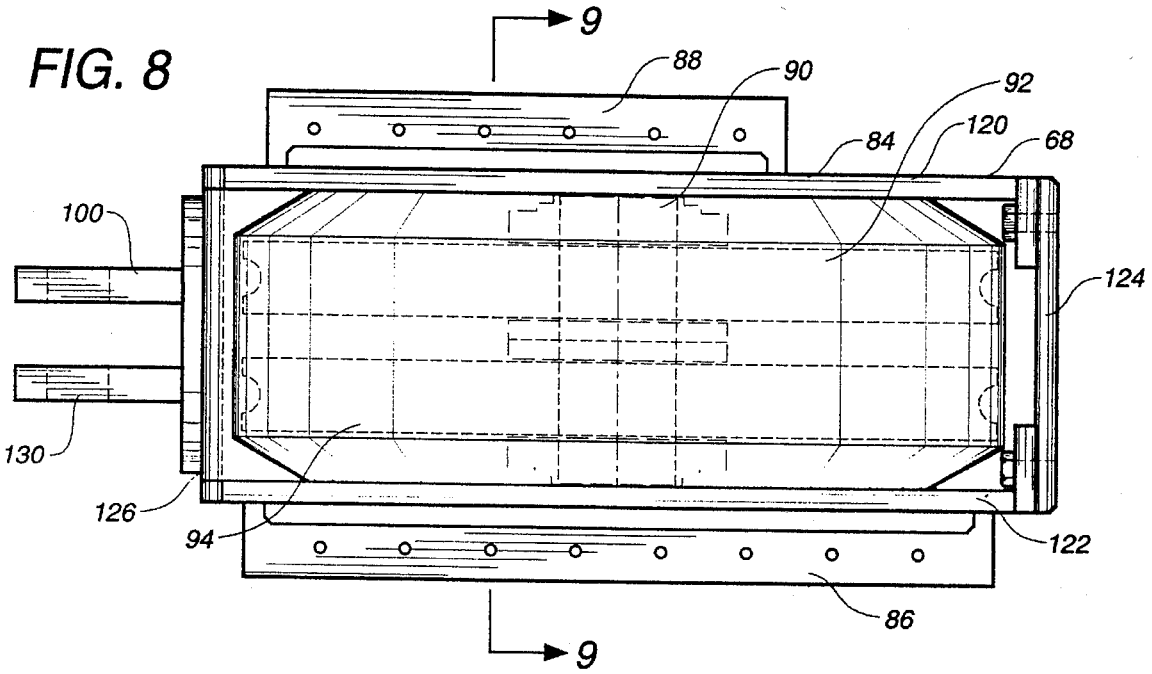
FIG. 8 is a plan view of the sheave housing of the present invention.

FIG. 8 is an isolated view of the sheave housing 68. It can be seen that the sheave housing 68 has a generally rectangular frame 84 extending therearound. The frame 84 has side plates 120 and 122 and end plates 124 and 126. An axle 90 is positioned so as to extend between the side plates 120 and 122. Sheaves 92 and 94 are rotatably mounted on the axle 90. The end plate 126 supports clevis bracket 100 thereon. The clevis bracket 100 includes an opening 130 so as to allow for the introduction of the clevis pin 102. Slide members 86 and 88 extend outwardly from the side plates 120 and 122, respectively. The slide members 86 and 88 will slidably receive the surfaces of the tubular rails of the guide frame 66.

Figure 9:
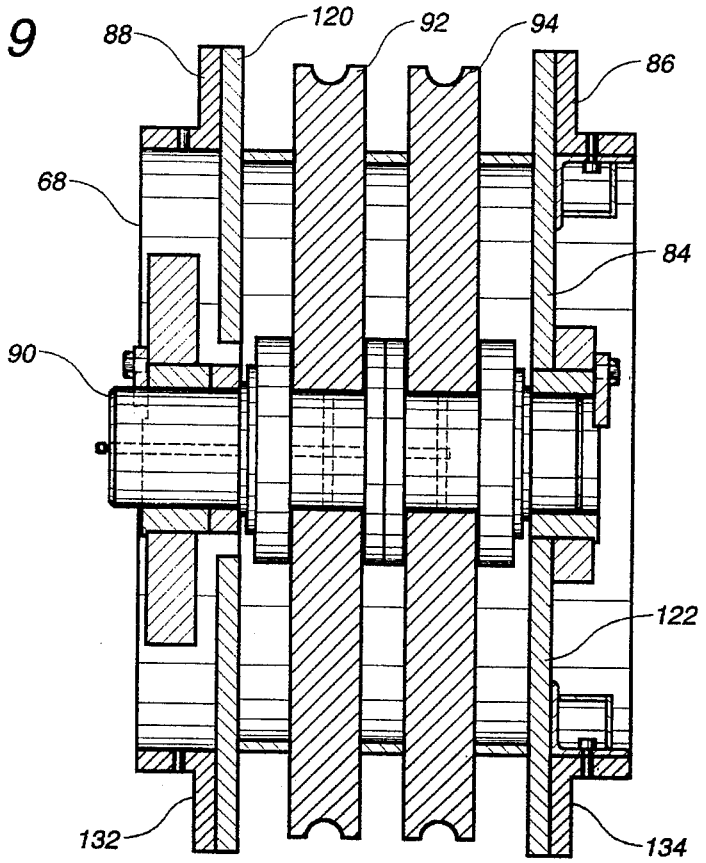
FIG. 9 is an end view of the sheave housing of the present invention.

FIG. 9 shows a cross-sectional view of the sheave housing 68 of the present invention. In particular, it can be seen that the sheaves 92 and 94 are supported on axle 90 within the interior of the sheave housing 68. Side plates 120 and 122 extend in parallel relationship to each other and also in parallel relationship to the sheaves 92 and 94. Importantly, the configuration of the slide members 86 and 88 are illustrated with particularity in FIG. 9. It can be seen that the slide members 86 and 88 have a generally L-shaped configuration. These slide members 86 and 88 will engage the top tubular rails 70 and 72 of the guide frame 66. The slide members 86 and 88 have ultra high molecular weight polyethylene affixed to their surfaces so as to assure low friction contact with the rails 70 and 72, to prevent rusting, and to assure generally maintenance-free operation. Another pair of L-shaped slide members 132 and 134 are positioned at the bottom of the side plates 120 and 122. The slide members 132 and 134 will slidably engage the bottom tubular rails of the guide frame 66.

Figure 10:
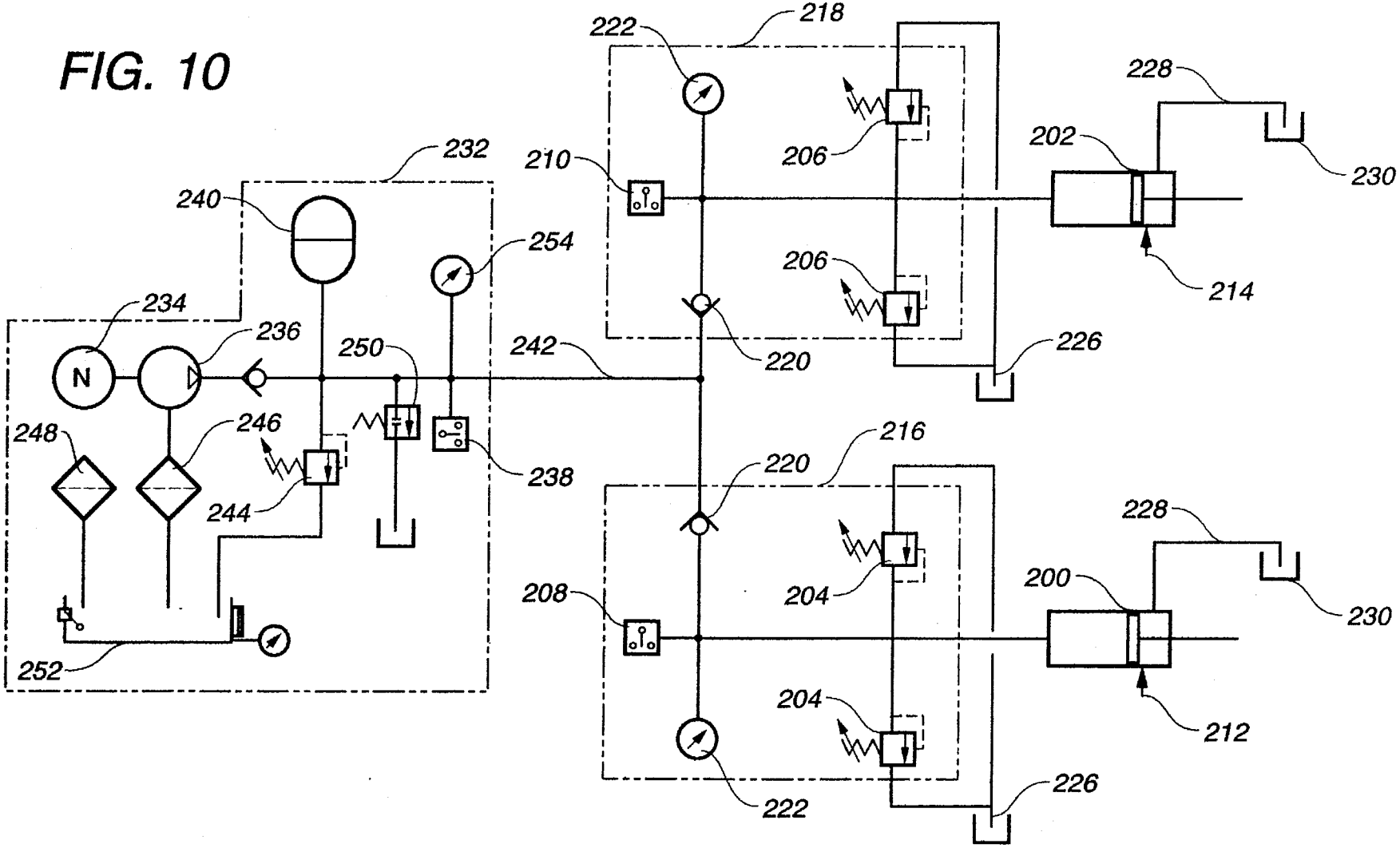
FIG. 10 is a schematic diagram of the hydraulic system of the present invention.

Referring to FIG. 10, there is shown the schematic flow diagram of the hydraulic system of the present invention. In particular, the hydraulic system is illustrated with reference to the hydraulic cylinders 200 and 202. As can be seen, the hydraulic configuration for each of the hydraulic cylinders 200 and 202 is independent and identical. An overload on either end of the spreader will stop the hoisting motion and will absorb the hoist momentum through the hydraulic cylinders 200 and 202 and the dual relief valve 204 and 206. Pressure switches 208 and 210 and position limit switches 212 and 214 are used to signal an overload condition.

The hydraulic pressure of the system, when operational, will vary from 200 p.s.i. to 1,100 p.s.i. depending upon the load on the spreader. This system pressure will only be seen by the elements in either of the cylinder manifolds 216 and 218. Each of the cylinder manifolds 216 and 218 will include a check valve 222, a pressure switch 208 and 210, a pressure gage 220, and cylinder relief valves 204 and 206. Each of the cylinder manifolds 216 and 218 includes a return line hose 226. These return line hoses 226 will see little pressure since they are downstream of the relief valves 204 and 206. There is also a supply hose 228 from the reservoir 230 to the cylinders 200 and 202. These supply hoses 228 allow hydraulic fluid to be passed to the non-pressure side of the reacting hydraulic cylinders 200 and 202.

The cylinders 200 and 202 are extended and maintained in this extended position by a hydraulic power unit 232. The hydraulic power unit includes a motor 234 and a pump 236. The hydraulic power unit 232 turns itself on and off through the use of a pressure switch 238. Any leakage in the cylinders 200 and 202 will draw down the reserve pressure maintained in an accumulator 240. Any leakage of the cylinders 200 and 202 would eventually reduce the system pressure during the empty spreader portion of the hoisting cycle below the low pressure set point of 200 p.s.i. This will trigger the power unit 232 to pump the system back up to a 500 p.s.i. level. Due to the downstream check valves 220, the reminder of the hydraulic system, including the supply hose 242, will see a maximum maintenance pressure of 500 p.s.i. The pump 236 (and other components) are protected from over pressure by a relief valve 244. The entire system is protected from contamination by dual element spin-on hydraulic suction filters 246 and 248. A purge valve 250 is provided so as to allow for the hydraulic pressure in the power unit 232 and the accumulator circuit to be relieved. It is important to note that the hydraulic circuits 216 and 218 for the cylinders 200 and 202 do not have a purge valve due to the cylinder retraction which will occur when the pressure is relieved. There is also a potential for system failure through the use of such a purge valve. The cylinders 200 and 202 can be relieved of pressure under control by removing the pressure gages 222 without a load on the hoist. The main reservoir 252 is provided within the power unit 232 so as to supply the pump 236 and the associated elements of the system with hydraulic fluid. A pressure gage 254 is provided in the power unit 32 to provide an indication of the level of pressure within the system.

The power unit 232 is located beside the existing between-the-booms walkway and the rear girder platform. This allows for servicing all of the components from a standing position. It should be noted that each of the cylinders 200 and 202 has two hydraulic relief valves 204 and 206 which function together so as to dissipate the volume of hydraulic fluid in a sufficient time considering the hoist's high speed setting. The cylinder proximity switches 212 and 214 are mounted on frame 66.

The snag load system of the present invention basically comprises two independent hydraulic cylinders in two sliding guide assemblies which house the existing rear back-reach return sheaves. Each cylinder/slide assembly/return sheaves pair supports the paired hoist ropes for either end of the spreader. Each hydraulic cylinder is retracted only by an overload and dissipates the energy of "snag loads" and momentary overloads through the passage of hydraulic fluid over relief valves. Each of the two assemblies is identical and independent. An overload on either end of the spreader will stop the hoisting motion and absorb the hoist momentum through the large bore hydraulic cylinder and the dual relief valves. After an overload is found, then a reset of the system is required before the load can be carried upwardly. The system is free to allow for the easy lowering of the load.

The foregoing disclosure and description of the invention is illustrative and explanatory thereof. Various changes in the details of the illustrated construction may be made within the scope of the appended claims without departing from the true spirit of the invention. The present invention should only be limited by the following claims and their legal equivalents.

I claim:

1. A snag load protection system for a crane comprising:

a guide frame;

a sheave housing slidably received within said guide frame, said sheave housing having means therein for receiving a rotatable sheave; and a hydraulic cylinder means connected to said guide frame and to said sheave housing, said hydraulic cylinder means for exerting a compressive force against said sheave housing so as to resist relative movement between said guide frame and said sheave housing when forces exerted by said sheave housing are within a predetermined value, said hydraulic cylinder means comprising:

a piston rod having one end connected to said sheave housing;

a cylinder receiving an opposite end of said piston rod, said cylinder affixed to said guide frame;

hydraulic supply means connected to said cylinder for supplying fluid to said cylinder at a desired pressure, said hydraulic supply means comprising:

a fluid reservoir;

a fluid line extending from said fluid reservoir to said cylinder; and pressurizing means connected to said fluid line for pressurizing the fluid in said cylinder, said pressurizing means comprising:

a pump connected to said fluid line; and a pressure switch means connected to said fluid line and to said pump, said pressure switch means for actuating said pump when the pressure of the fluid in the line falls below a predetermined value;

a relief valve means connected to said hydraulic supply means, said relief valve means for releasing said hydraulic fluid from said cylinder when the forces exceed the predetermined value; and a pressure sensor means connected to said hydraulic cylinder means, said pressure sensor means for transmitting a signal when the forces exceed the predetermined value.

2. The system of claim 1, further comprising:

a position limit switch means connected to said guide frame for transmitting a signal when the relative movement between said guide frame and said sheave housing exceeds a predetermined distance.

3. The system of claim 2, further comprising:

a motor means electrically connected to said pressure sensor means and to said position limit switch means, said motor means for hoisting a load, said signal of said pressure sensor means and said signal of position limit switch means for stopping said motor means.

4. The system of claim 1, said guide frame having a plurality of horizontal rails extending parallel to each other, said sheave housing having a plurality of slide members formed on an exterior surface thereof, said slide members in slidable relationship with said rails.

5. The system of claim 4, said rails being of a generally square tubular configuration, each of said slide members having an L-shaped configuration, each of said slide members being of an ultra-high molecular weight polyethylene material.

* * * * *